United States Patent [19]

Lombardino et al.

[11] 4,447,953

[45] May 15, 1984

[54] CHAIN SAW GUARD

[76] Inventors: Anthony V. Lombardino, 113-15 84th Ave., Richmond Hill, N.Y. 11416; Louis P. Perfetto, 18-11 154th St., Whitestone, N.Y. 11357

[21] Appl. No.: 406,352

[22] Filed: Aug. 9, 1982

[51] Int. Cl.[3] ..... B27B 17/02

[52] U.S. Cl. ..... 30/382

[58] Field of Search ..... 30/122, 296 R, 381, 30/382, 383, 384

[56] References Cited

U.S. PATENT DOCUMENTS

| | | | |
|---|---|---|---|
| 3,059,673 | 10/1962 | Woleslagle | 30/382 X |
| 3,380,493 | 4/1968 | Giroux | 30/382 |
| 3,384,136 | 5/1968 | Marin | 30/382 |
| 3,754,328 | 8/1973 | Knerr | 30/382 |
| 3,808,684 | 5/1974 | Ludwig | 30/382 |
| 3,991,470 | 11/1976 | Cartmill | 30/382 |
| 4,060,894 | 12/1977 | Hampton | 30/382 |
| 4,365,416 | 12/1982 | Overbury | 30/382 |

FOREIGN PATENT DOCUMENTS

| | | | |
|---|---|---|---|
| 2134629 | 1/1973 | Fed. Rep. of Germany | 30/382 |

*Primary Examiner*—Jimmy C. Peters

*Attorney, Agent, or Firm*—Collard, Roe & Galgano

[57] ABSTRACT

A guard for a chain saw of the type having a housing and an elongated saw blade projecting outwardly from the housing including an endless chain having an upper run and a lower run includes an elongated guard arm having a generally arcuately-shaped cross-section, and a spring-loaded hinge pivotably connecting the guard arm at one of its ends to the housing for movement between a first and second end position. In the first end position, the guard arm overlies and extends above the upper run of the chain in a spaced-apart generally parallel relationship thereto, and in the second end position, the guard arm extends upwardly generally normally relative to the chain upper run. The guard arm is resiliently biased by the spring-loaded hinge so that it normally assumes and is urged into the first end position thereof.

17 Claims, 16 Drawing Figures

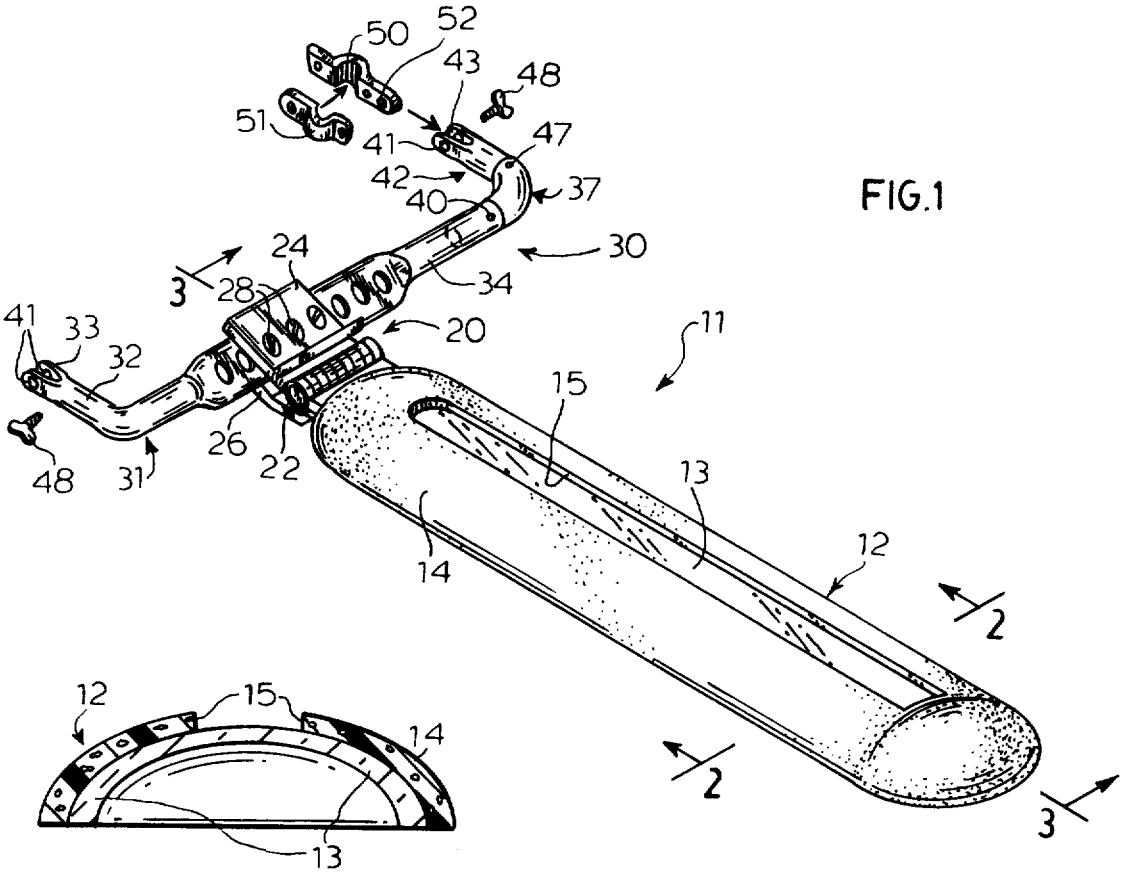
FIG.1
FIG.2
FIG.3
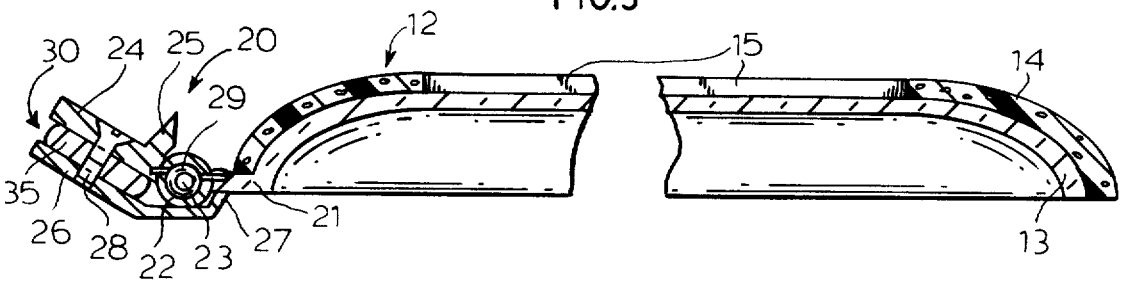

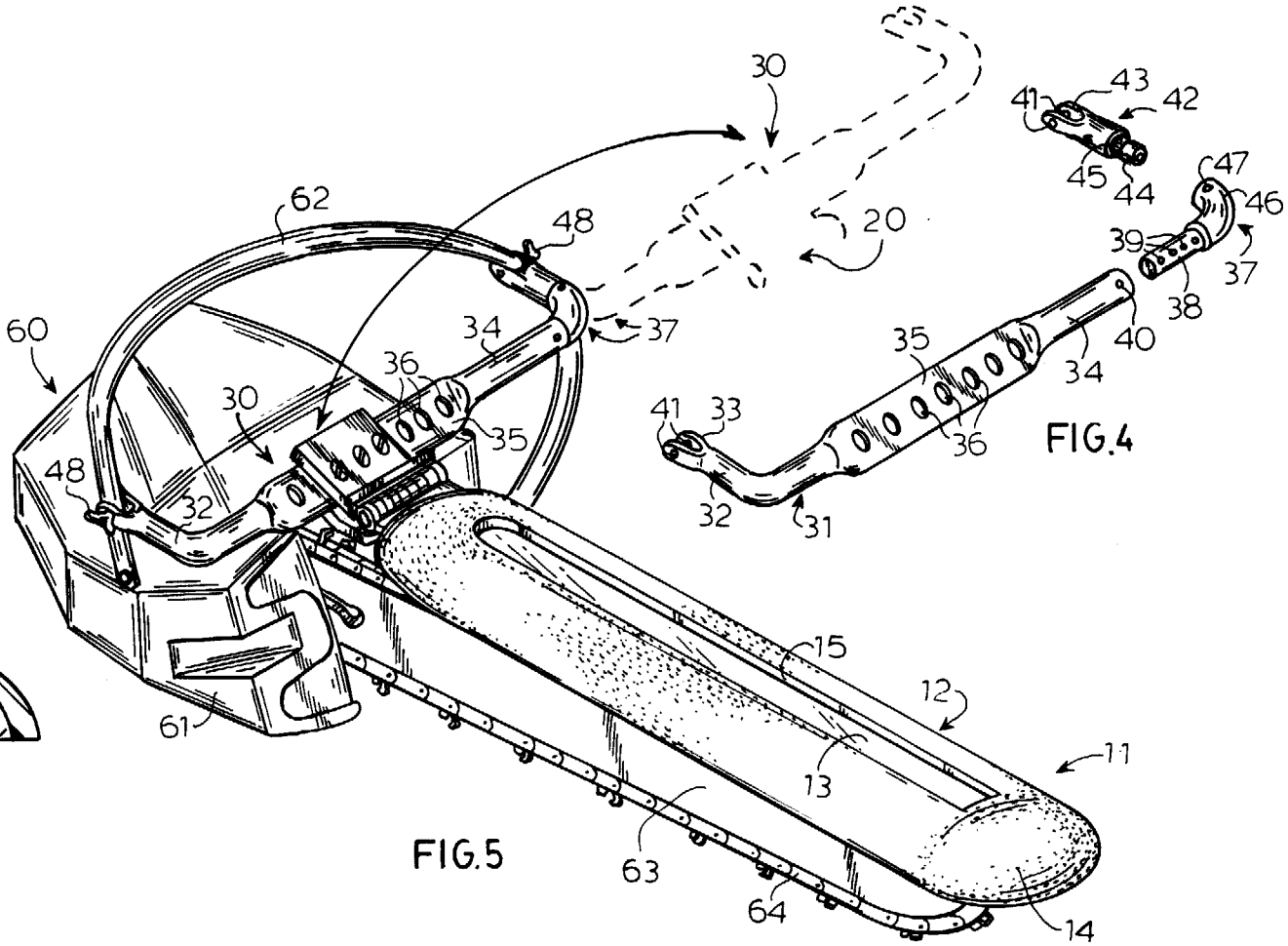
FIG.4
FIG.5
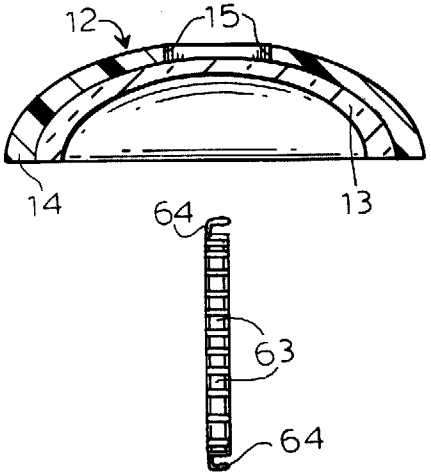
FIG.6

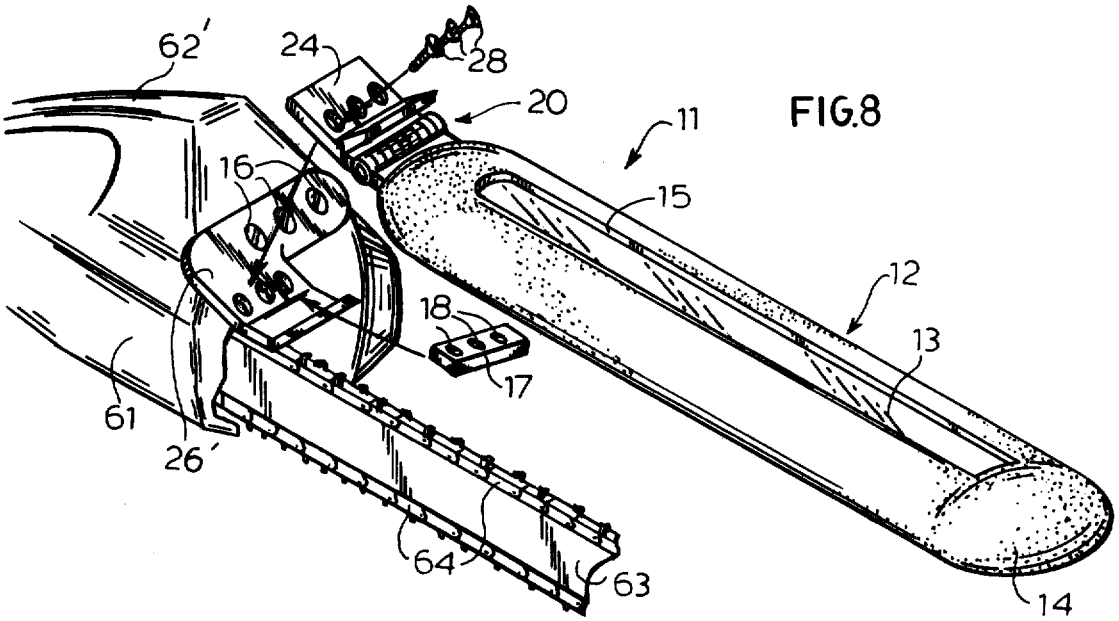
FIG.8
FIG.9
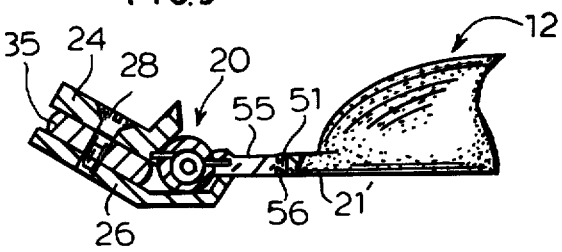
FIG.7
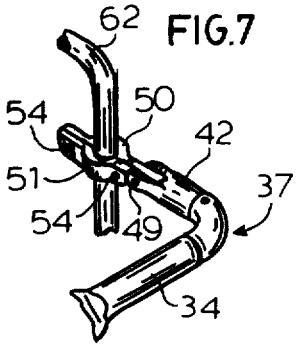
FIG.10
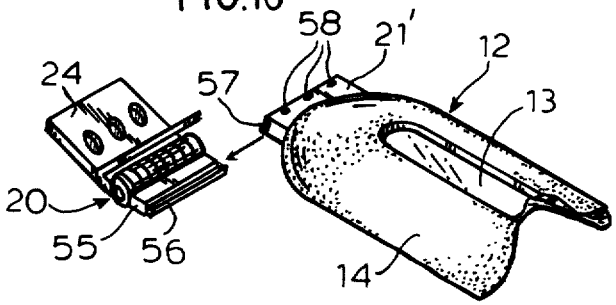

FIG.15
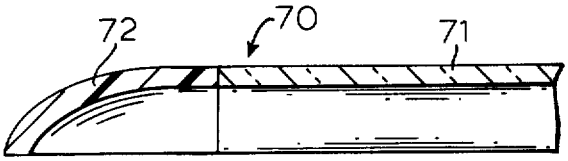
FIG.14
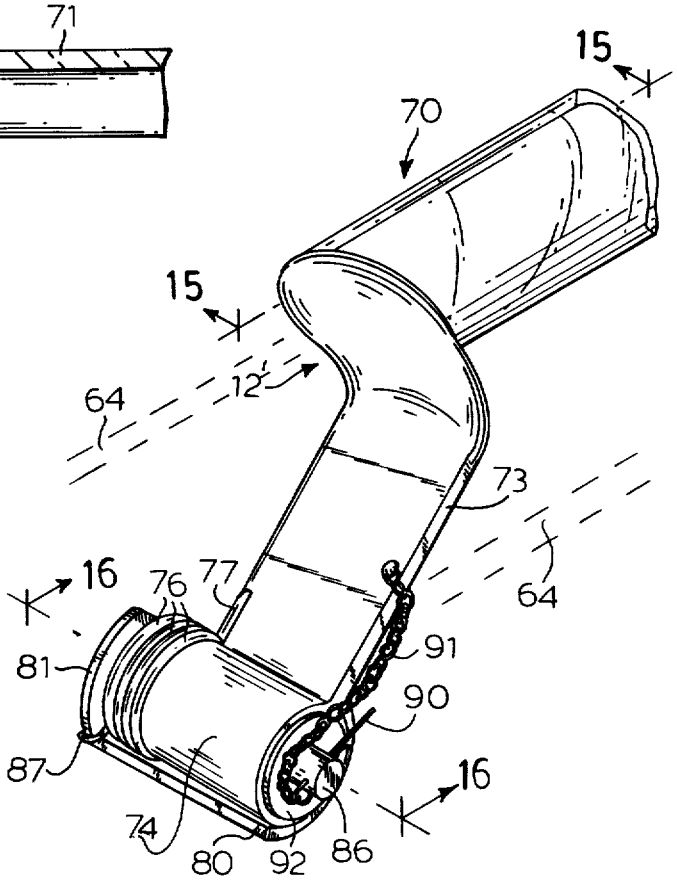
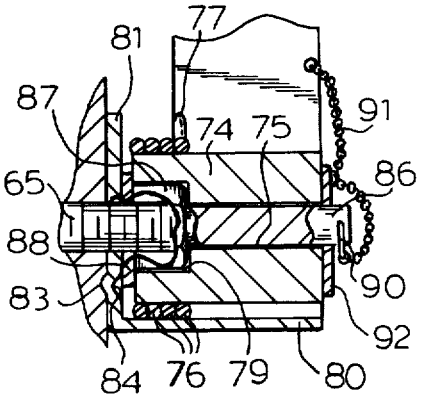
FIG.16

CHAIN SAW GUARD

FIELD OF THE INVENTION

The present invention relates to a chain saw guard. More particularly, it relates to a chain saw guard which serves to protect the operator from chain saw "kick-back".

BACKGROUND OF THE INVENTION

The use of hand-held, typically gas operated chain saws, has become quite prevalant today, and concomitant therewith, there has been an increase in the number of injuries associated with the use of such chain saws. One of the main causes of injury is so-called chain saw "kickback", which is caused, e.g., by the chain striking a knot in the wood or by the upper run of the chain engaging a branch or log while being operated. In either event, the chain saw "kicks back" and, if the operator is unprepared, the momentum may carry the chain saw back far enough, allowing the upper edge of the chain to strike the operator in the chest or head, causing severe injury.

To overcome this problem, various chain saw guards have been proposed to minimize this problem (see, e.g., U.S. Pat. Nos. 988,112; 2,937,673; 3,636,996; 3,384,136; 3,991,470; 4,060,894; and 4,294,012). While perhaps satisfactory, they generally have been found to have certain drawbacks. For example, some are rather complicated in construction and cumbersome to use. Others do not allow for ready attachment to a variety of different types of chain saws, nor afford easy assembly and disassembly. Still others do not allow for ready viewing of the chain, while at the same time affording protection to the operator from flying debris and the possibility of chain saw kickback. Further, no presently-available chain saw guard appears to be as simple in construction and operation, safe and as easy to use, as the chain saw guard hereinafter disclosed.

Accordingly, it is an object of the present invention to provide a novel chain saw guard which is specifically intended to protect the operator from chain saw "kick-back".

It is a further object of the present invention to provide such a chain saw guard which is simple in construction and operation and economical to manufacture.

It is a another object of the present invention to provide such a chain saw guard which is readily removable and exchangeable and which is dependable and reliable in operation.

It is a more particular object of the present invention to provide a chain saw guard having the following attributes and characteristics, which is readily adaptable to conventional chain saws, which is lightweight and easy to use.

SUMMARY OF THE INVENTION

Certain of the foregoing and related objects are readily attained in a guard for a chain saw of the type having a housing and an elongated saw blade projecting outwardly from the housing including an endless chain having an upper run and a lower run, which includes an elongated guard arm having a generally arcuately-shaped cross-section, and spring-loaded hinge means pivotably connecting the guard arm at one of its ends to the housing for movement between a first and second end position. In the first position, the guard arm overlies and extends above the upper run of the chain in a spaced-apart generally parallel relationship thereto, and in the second end position, the guard arm extends upwardly generally normally relative to the chain upper run. The guard arm is resiliently biased by the spring-loaded hinge means so that it normally assumes and is urged into the first end position thereof.

Most desirably, at least a portion of the guard arm is at least semi-transparent so as to serve as a viewing window. This portion is disposed in the center of the guard arm so as to extend above and along at least a portion of the upper run of the chain to permit visual inspection of the chain during operation.

Preferably, the guard arm is made of at least partially transparent plastic material and is covered with a cushioning ply, except in the area of the portion thereof which serves as the viewing window. The cushioning ply is advantageously made from foam rubber which preferably has a light-reflective coating thereon.

In a preferred embodiment of the invention, the guard arm is detachably secured to the hinge means. Most advantageously, the guard arm is detachably secured to the hinge means by means of a dovetail-shaped tongue-and-groove connection.

The hinge means preferably includes a pair of pivotably-coupled hinge leaves, one of which is secured to the one end of the guard arm, and the other leaf of which has mounting means for securing the same to the housing. The other hinge leaf advantageously has a flange projecting upwardly therefrom which serves as a stop when the guard arm moves into the second end position thereof. The hinge means also desirably additionally includes a hinge support plate coupled to the other hinge leaf, which plate has a flange at one end thereof which serves as a stop, so as to support the guard arm in the first end position thereof.

In a particularly preferred embodiment of the invention, the mounting means for the other leaf includes a support bar having means for detachably securing the support bar to the housing and the other hinge leaf and the hinge support plate are detachably secured to this support bar. The support bar advantageously includes a pair of telescoping tubular members to permit adjustment of the length thereof and pivot means to permit pivoting of the support bar and, in turn, the guard, between an operative position disposed above the saw blade, and an inoperative position disposed to the side of the saw blade. Alternatively, the hinge support plate may serve as the mounting means for the other leaf and include means for detachably securing the same to the housing.

In an especially preferred embodiment of the invention, the guard arm is secured to a laterally offset cylindrical hub having an axial bore by means of an offsetting shoulder segment and the hinge means includes a shaft having means for demountably securing the same on the elongated saw blade, so that it extends normally therefrom, with the hub being rotatably mounted on the shaft via its axial bore. The hinge means also includes a generally semicylindrical sleeve mounted on the shaft and fixed in position relative thereto, which sleeve has a longitudinal guard edge at one end and a longitudinal spring back edge at its other end which are disposed for abutting engagement with the shoulder segment, so as to limit movement of the guard arm between the first and second end positions thereof, respectively. The hinge means also includes a helical spring means received on the hub, one end of which is secured to the shoulder segment and the other end of which is received against the spring back edge, so as to bias the guard arm in a direction towards the first end position thereof.

Most advantageously, the means for demountably securing comprises an internally-threaded nut secured to one end of the shaft, and the shaft is provided with a radially-extending bore formed through the other end thereof. The hinge means also preferably includes a cotter pin receivable through the axial bore for securing the hub on the shaft. The sleeve desirably includes an annular end wall at one end thereof provided with two male detents on the outer wall thereof, disposed for cooperation with corresponding female detents provided on the chain saw blade.

BRIEF DESCRIPTION OF DRAWINGS

In the drawings, wherein similar reference characters denote similar elements throughout the several views:

FIG. 1 is a perspective view of a novel chain saw guard embodying the present invention;

FIG. 2 is a transverse sectional view taken along line 2—2 of FIG. 1;

FIG. 3 is a longitudinal sectional view taken along line 3—3 of FIG. 1;

FIG. 4 is an exploded perspective view of the support bar for the chain saw guard;

FIG. 5 is a perspective view showing the chain saw guard mounted on a chain saw with the support guard bar shown in FIG. 4, and showing in phantom line an alternate pivoted position thereof;

FIG. 6 is a front end view, in part section, of the chain saw blade and guard arm relative to their respective positions as shown in FIG. 5;

FIG. 7 is a fragmentarily-illustrated, perspective view showing an alternate method for mounting the chain saw guard;

FIG. 8 is a fragmentarily-illustrated, partially exploded perspective view of an alternate embodiment of the chain saw guard;

FIG. 9 is a fragmentarily-illustrated, sectional view, in part elevation, showing an alternate method for securing the guard arm to the hinge assembly by means of a dovetail-shaped tongue-and-groove joint;

FIG. 10 is an exploded, perspective view comparable to that of FIG. 9, but showing the guard arm removed from the hinge assembly;

FIG. 14 is a fragmentarily-illustrated, perspective view of the chain saw guard of FIG. 11, further showing the chain saw blade in phantom line;

FIG. 15 is a sectional view taken along line 15—15 of FIG. 14; and

FIG. 16 is a sectional view taken along line 16—16 FIG. 14.

DETAILED DESCRIPTION OF THE PREFERRED EMBODIMENTS

Figure 11:
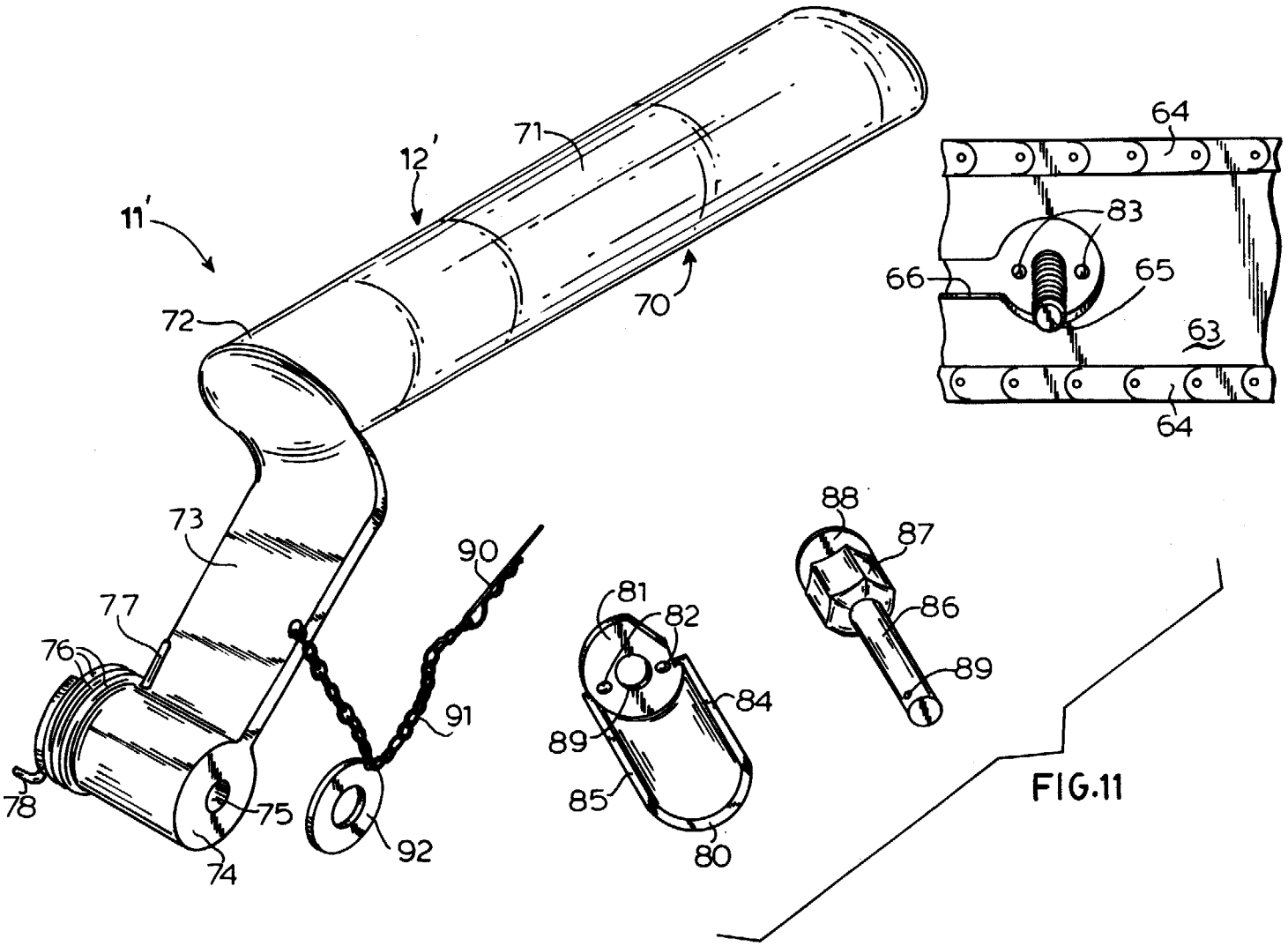
FIG. 11 is an exploded, perspective view of an alternate embodiment of the chain saw guard and a portion of the chain saw blade on which it is mounted.

Turning now in detail to the drawings, and, in particular, FIGS. 1-5 thereof, therein illustrated is a novel chain saw guard embodying the present invention, generally designated by reference numeral 11. The chain saw guard basically includes a guard arm 12, a hinge assembly 20 and a support bar 30.

As shown in FIG. 5, the chain saw guard 11 is intended for mounting on a typically gas-powered, conventional chain saw, generally designated by reference numeral 60, which includes a housing or casing 61, a handle bar 62 supported on the housing 61, a chain saw blade comprising a guide plate 63 projecting from the forward side of the chain saw housing 61 and acting as a guide for supporting an endless chain 64. Inasmuch as the chain saw is conventional, its construction is well known to those skilled in the art and, therefore, it will not be described in detail hereinafter, except as to its specific relationship, relative to the chain saw guard of the present invention.

As can be seen best in FIGS. 1-3, the guard arm or shroud 12 has an elongated, generally oval or elliptical shape and is composed of a base member 13 having a generally arcuate cross-sectional shape, which is preferably made from an impact-resistant, transparent or translucent conventional plastic material. The top surface of base member 13 is, in turn, covered with a ply 14 of cushioning material, such as foam plastic or rubber, which is preferably provided with a highly reflective upper surface or coating. There is an elongated slot 15 in the center portion of covering ply 14, so as to define a central viewing window along the length of the guard arm 12; the purpose for which will be described in greater detail hereinafter.

As seen best in FIG. 3, the inner end of guard arm 12 has an outwardly-projecting flange 21 which serves as one hinge leaf of hinge 20 and which is pivotably coupled via the associated cooperating knuckles 22 and hinge pin 23 to hinge leaf 24. Hinge leaf 24 is provided with an upwardly extending angled flange 25, adjacent to knuckles 22, which serves as an upper stop for the pivotable guard arm 12. The hinge is spring-loaded by means of a helical spring 29, one end of which abuts hinge leaf 24 and the other end of which abuts flange 21 to effect biasing of guard arm 12 in a direction away from flange 25 in a clockwise direction.

In addition, a hinge support plate 26 is provided, the forward end of which has an upturned flange 27, which serves as a stop for supporting the guard arm 12 in a generally horizontal position, as described in greater detail hereinafter. Hinge leaf 24 is further provided with three spaced-apart holes and hinge support plate 26 is provided with three corresponding screw holes in which screws 28 may be inserted for mounting the same on opposite sides of support bar 30.

As shown in FIG. 4, the generally U-shaped support bar 30 is segmented and is composed of three elements. The first element is an L-shaped main member or segment 31 composed of a short tubular arm 32 having a yoke-shaped coupling member 33 at the end thereof and a longer, generally tubular arm 34. Arm 34 has a generally flattened, bar-like portion 35 with a row of spaced-apart holes 36 formed therein with which the holes of hinge leaf 24 and hinge support plate 26 may be aligned, with hinge leaf 24 and hinge support plate 26 disposed above and below the bar-like portion 35, respectively, to permit fastening thereto by means of screws 28; the additional holes 36 in the row being provided to allow for a positional adjustment as described hereinafter.

Support bar 30 also includes an elbow-shaped member 37 having a relatively longer inner tubular arm 38 which is telescopically receivable in an adjustable manner within the free end of the longer arm 34 of L-shaped member 31 and which is provided with a longitudinally-extending row of holes 39. The corresponding end of arm 34 is provided with a set screw 40 mounted within a set screw hole for effecting detachable securement of elbow 37 to arm 34 in a longitudinally-adjustable manner via its receipt within one of holes 39; as can be appreciated, this permits adjustment of the overall effective length of the support bar 30 to accomodate a wide range of handle bar widths.

Finally, the support bar 30 includes an arm extension member 42 having a yoke-shaped coupling member 43 at the outer end thereof and a cylindrical rod-shaped segment 44 at the inner end thereof, which has an annular, generally U- or V-shaped, circumferentially-extending channel 45 spaced from the inner end thereof. Cylindrical rod-shaped segment 44 is telescopically-receivable within a correspondingly-configured tubular arm 46 of elbow 37, which is provided with a set screw 47 received in a set screw hole which, when rod 44 is received within tubular end 46, is screwed into annular groove 45 and, depending upon the degree of tightness, will either provide a rigid or sliding coupling, respectively, therebetween.

Each of the yoke-shaped coupling elements 33, 43 are provided with holes 41 extending through the yoke arms thereof which are alignable with corresponding bores (not shown) in arm 62. Threaded wing bolts 48 are received through the aligned holes and are fastened with corresponding nuts 49 to effect secure mounting of the support bar 30 on arm 62 of chain saw 60. As shown in FIG. 5, if during operation it is necessary to remove the guard 11 to inspect the chain saw blade 63, complete detachment of the guard 11 is not necessary. Instead, the bolt and nut assembly associated with yoke 33 is removed and the set screw 47 associated with arm extension 42 is loosened, so as to permit pivoting of the support arm 30 to the position shown in phantom view. In this way, the guard 11 is displaced laterally to one side of the chain saw 60 to permit inspection and any other necessary work on the chain saw blade 63 or housing 61 without interference from the guard 11.

If it is not possible to drill through the chain saw handle 62, a pair of additional, generally U-shaped clamp members 50, 51 may be employed, as shown in FIGS. 1 and 7. Coupling member 50 is provided with a longer arm with a bore 52 therethrough which is receivable between the yoke arms 43 of arm extension member 42 such that its bore 52 is aligned with bores 41. A bolt 48 would then be inserted therethrough to securely fasten the coupling member 50 via a nut 49 to extension member 42. Then the handle 62 of the chain saw 60 would be positioned between the two coupling elements 50 and 51, as shown in FIG. 7, and additional bolts 48 and nuts 49 (not shown) or screws 54 would be employed to effect secure clamping of support bar 30 to handle 62.

FIG. 8 illustrates an alternate mounting embodiment for the chain saw guard 11 where, due to the configuration of the handle 62', an alternate mounting site is required. In this case, the guard arm is mounted directly on the chain saw housing 61 by means of a hinge support leaf 26' which is provided with several mounting holes and screws 16 for securing the same to the chain saw casing 61. The operation and functioning of the device is otherwise the same as the device shown in FIG. 1 and FIG. 5, except that in place of a bar-like portion 35, a spacer bar 17 having a row of holes 18 is employed.

FIG. 9 discloses an alternate embodiment for mounting the guard arm flange 21' on the hinge assembly 20. In this case, the guard arm 12 is detachably secured to a separate hinge leaf 55 by means of a dovetail-shaped tongue 56-and-groove-57 connection in the ends of the hinge leaf 55 and the guard arm flange 21', which is held in place by means of set screws 58 to prevent sliding in the manner shown in FIG. 10. As can be appreciated, such a method of construction will enable easy and quick replacement of the guard arm, if such should become damaged, without requiring the total removal of the entire guard assembly.

Turning now to the overall operation of the device, in its normal position, the guard arm 12 is disposed in the position shown in FIG. 1 and FIG. 6 with the guard arm 12 spaced above and extending over the upper run of the chain 64 in a substantially parallel relationship thereto, it being biased downwardly by spring 22 but supported in this horizontal position by the support of the lower hinge support plate flange 27. The proper mounting position is easily obtained due to the adjustable mounting of guard arm 12 on support bar 30 via the row of holes 36 and the length adjustability of support bar 30.

In operation, as the operator cuts the log or other wooden structure, the guard will be pivoted upwardly against the force of the spring in order to permit the chain 64 to pass through the log. At the same time, the arcuate configuration of the guard arm 12 will prevent any debris from striking the operator and the viewing window 15 thereof will also permit the operator to carefully view the cutting operation. If, for any reason the chain saw 60 should kick back, the guard arm 12 will prevent the upper run of the chain 64 from striking the operator. The upper cushioned layer 14 of the chain guard 11 will also provide additional safety to the user, as will the stop 25 of the upper hinge leaf 24, which will only permit a 90° pivoting of the guard arm 11.

Figure 12:
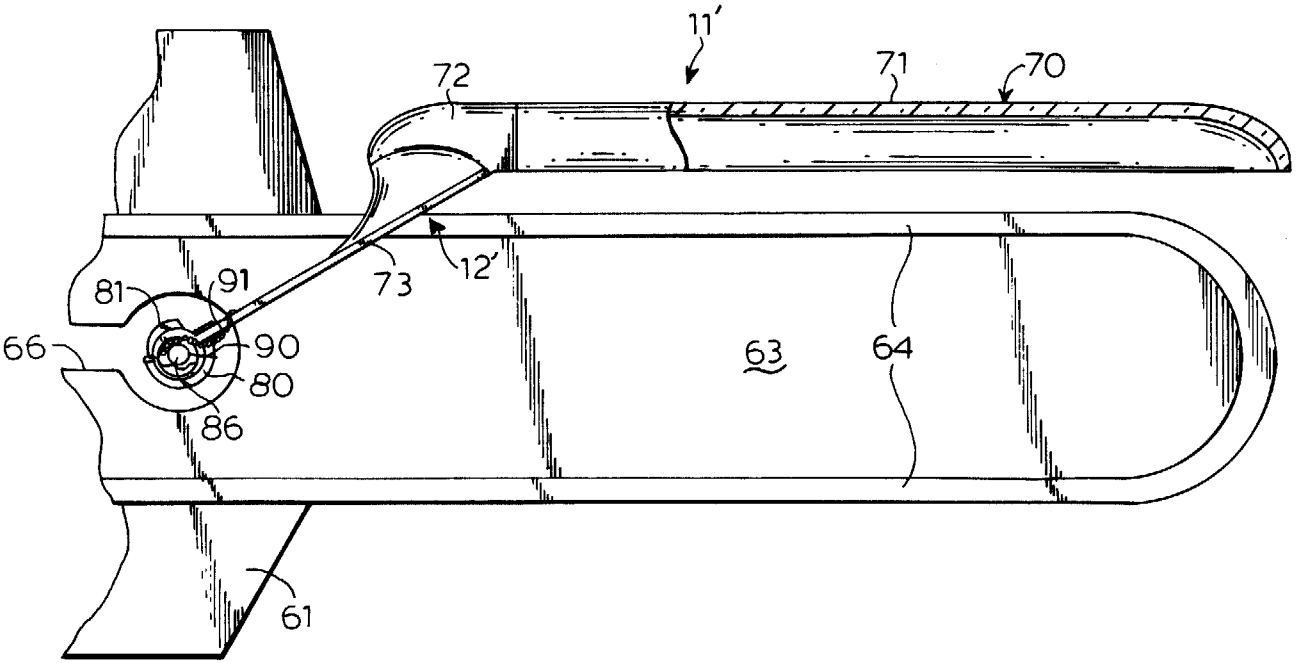
FIG. 12 is a side elevational view, in part section, of the alternate embodiment of the chain saw guard shown in FIG. 11, mounted on a chain saw.
Figure 13:
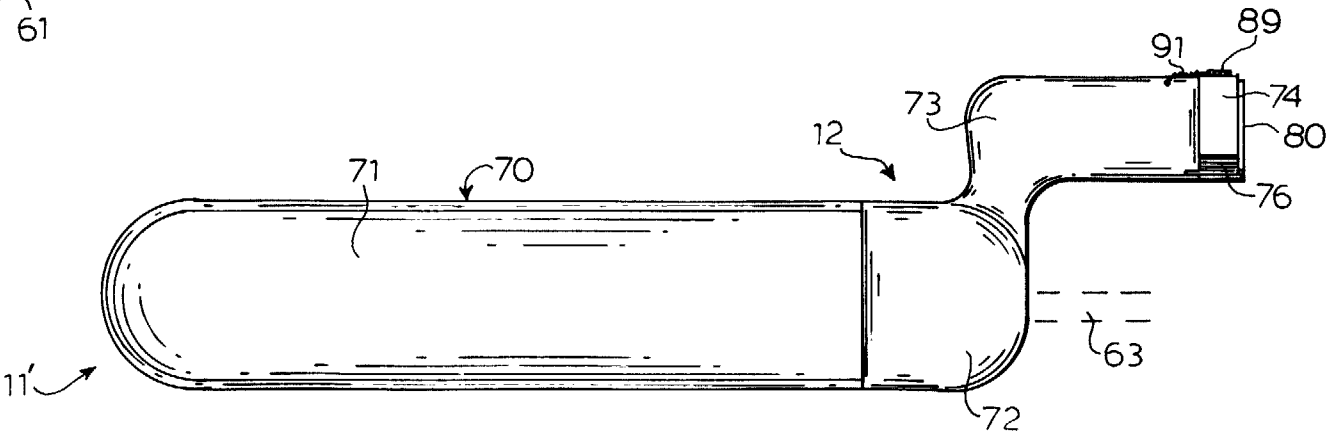
FIG. 13 is a top, plan view of the chain saw guard shown in FIG. 12, but with its position reversed, further showing the chain saw blade in phantom line.

FIGS. 11–16 illustrate an alternate embodiment which permits mounting of the chain saw guard 11' directly on the chain saw threaded bolt 65 associated with the chain saw blade 63 and which, via slot 66 and a cooperating nut (not shown), is used to adjust the longitudinal extension of blade 63 and, in turn, the tension on chain 64 in a known manner. As can be seen in FIGS. 11–13, the chain saw guard 11' basically includes a guard arm 12' composed of an elongated, main shroud member 70 having a generally oval or elliptical shape and having a generally arcuate cross-sectional shape. The front portion 71 of main shroud member 70 is preferably made from impact-resistant, transparent plastic material, whereas the rear end portion 72 thereof is preferably made from a black or cloudy translucent, impact-resistant plastic material. The rear end portion 72 is generally flat, and is secured integrally or otherwise to a generally flat, laterally offset shoulder segment 73 which, in turn, is attached to a cylindrical hub 74 having a central bore 75. A helical coil spring 76 is mounted on the rear end of hub 74, one end of which 77 is received within a hole of shoulder segment 73.

Hub 74 is received within a generally semicylindrical sleeve 80 having a single, generally annular end face 81 against which the rear end of hub 74 abuts. Annular end 81 has two male detents 82 projecting outwardly therefrom from its outer face which are intended for mating receipt within a pair of correspondingly dimensioned and positioned female detents formed on opposite sides of bolt 65. This insures the proper positioning of sleeve 80 and its longitudinal guard support edge 84 and longitudinal spring back edge 85 which serve as stops for and control the pivotable movement of guard arm 12'. It should also be noted that in this mounted position, the other spring end 78 rests against spring back edge 85 so as to effect biasing of the guard arm into the first end position thereof.

The subassembly of hub 74 and sleeve 80 are, in turn, mounted on a smooth shaft 86, one end of which is secured to a threaded nut 87 which, in turn, is welded to a washer 88. As seen best in FIG. 16, shaft 86 is inserted through the center bore 89 of annular end 81 and bore 75 of hub 74, the latter bore of which is also provided with a widened cavity 79 at its rear end to permit receipt therein of nut 87, while still permitting free rotation of hub 74 on shaft 86.

The outer end of shaft 86 is provided with a bore 89 for the receipt therein of a cotter pin 90 which is mounted on a chain 91, together with a washer 92, which chain is securely fastened to the shoulder segment 73. The washer 92 and the cotter pin 90 are used in cooperation to securely fasten the subassembly of hub 74 and sleeve 80 to the shaft 86.

Guard arm 11' operates in a manner comparable to that of the previously-described embodiments. As seen best in FIG. 12, in its normal position, the guard arm 12' normally overlies and is disposed parallel to the guard saw blade 63, this being due to the fact that the lower end of shoulder segment member 73 rests against the guard support edge 84 of sleeve 80. When in operation, and as the operator cuts the log or other wooden structure, the guard 11' will be pivoted upwardly against the force of spring 76, in order to permit the chain 64 to pass through the log. Here too, at the same time, the arcuate configuration of the guard arm 12' will prevent any debris from striking the operator and the transparent front portion 71 of the main shroud member 70 will also permit the operator to carefully view the cutting operation. If, for any reason, the chain saw should kick back, the guard arm 12' will, here too, prevent the upper run of the chain from striking the operator and, in addition, spring back edge 85 will limit the backward pivoting of guard arm 12'.

As can be appreciated, various modifications may be made, as will be apparent to those skilled in the art. For example, although plastic is preferred for the guard arm, other materials or combinations thereof may be employed.

Thus, while only several embodiments of the present invention have been shown and described, it is obvious that many changes and modifications may be made thereunto without departing from the spirit and scope of the invention.

What we claim is:

1. A guard for a chain saw of the type having a housing and an elongated saw blade projecting outwardly from said housing including an endless chain having an upper run and a lower run, comprising:

an elongated guard arm having a generally arcuately-shaped cross-section; and spring-loaded hinge means pivotably connecting said guard arm at one of its ends to said housing for movement between a first end position, in which said guard arm overlies and extends above said upper run of said chain in a spaced-apart generally parallel relationship thereto, and a second end position, in which said guard arm extends upwardly generally normally relative to said chain upper run, said guard arm being resiliently biased by said spring-loaded hinge means so that it normally assumes and is urged into said first end position thereof.

2. The guard of claim 1, wherein at least a portion of said guard arm is at least semi-transparent so as to serve as a viewing window, which portion is disposed in the center of said guard arm so as to extend above and along at least a portion of the upper run of the chain to permit visual inspection of said chain during operation.

3. The guard of claim 2, wherein said guard arm is made of at least partially transparent plastic material.

4. The guard of claim 2, wherein said guard arm is covered with a cushioning ply, except in the area of said portion thereof which serves as said viewing window.

5. The guard of claim 4, wherein said cushioning ply is made from foam rubber.

6. The guard of claim 4, wherein said cushioning ply has a light-reflective coating thereon.

7. The guard of claim 1, wherein said guard arm is detachably secured to said hinge means.

8. The guard of claim 7, wherein said guard arm is detachably secured to said hinge means by means of a dovetail-shaped tongue-and-groove connection.

9. The guard of claim 1, wherein said hinge means comprises a pair of pivotably-coupled hinge leaves, one of which is secured to said one end of said guard arm, and the other of which has mounting means for securing said other leaf to said housing.

10. The guard of claim 9, wherein said other hinge leaf has a flange projecting upwardly therefrom which serves as a stop when said guard arm moves into said second end position thereof.

11. The guard of claim 10, wherein said hinge means additionally includes a hinge support plate coupled to said other hinge leaf, which plate has a flange at one end thereof which serves as a stop so as to support said guard arm in said first end position thereof.

12. The guard of claim 11, wherein said mounting means includes a support bar having means for detachably securing said support bar to said housing and wherein said other hinge leaf and said hinge support plate are detachably secured to said support bar.

13. The guard of claim 11, wherein said hinge support plate serves as said mounting means for said other leaf and includes means for detachably securing the same to said housing.

14. The guard of claim 12, wherein said support bar comprises a pair of telescoping tubular members to permit adjustment of the length thereof and pivot means to permit pivoting of said support bar and, in turn, said guard, between an operative position disposed above said saw blade, and an inoperative position disposed to the side of said saw blade.

15. The guard of claim 1, wherein said guard arm is secured to a laterally offset cylindrical hub having an axial bore by means of an offsetting shoulder segment and wherein said hinge means comprises a shaft having means for demountably securing the same on the elongated saw blade, so that it extends normally therefrom, said hub being rotatably mounted on said shaft via said axial bore thereof, said hinge means also including a generally semicylindrical sleeve mounted on said shaft and fixed in position relative thereto, said sleeve having a longitudinal guard edge at one end and a longitudinal spring back edge at its other end disposed for abutting engagement with said shoulder segment so as to maintain said guard arm in said first and second end positions thereof, respectively, and said hinge means also including helical spring means received on said hub, one end of which is secured to said shoulder segment and the other end of which is received against said spring back edge, so as to bias said guard arm in a direction towards said first end position thereof.

16. The guard of claim 15, wherein said means for demountably securing comprises an internally-threaded nut secured to one end of said shaft, wherein said shaft has a radially-extending bore formed through the other end thereof and wherein said hinge means additionally includes a cotter pin receivable through said axial bore for securing said hub on said shaft.

17. The guard of claim 15, wherein said sleeve has an annular end wall at one end thereof provided with two male detents on the outer wall thereof, disposed for cooperation with corresponding female detents provided on said chain saw blade.

* * * * *